United States Patent [19]

Kline

[11] Patent Number: 4,483,752

[45] Date of Patent: Nov. 20, 1984

[54] VALVE METAL ELECTRODEPOSITION ONTO GRAPHITE

[75] Inventor: George A. Kline, Birmingham, Mich.

[73] Assignee: Eltech Systems Corporation, Chardon, Ohio

[21] Appl. No.: 425,443

[22] Filed: Sep. 28, 1982

[51] Int. Cl.[3] ..... C25C 3/26

[52] U.S. Cl. ..... 204/64 T

[58] Field of Search ..... 204/39, 45 R, 64 T, 204/181 N, 67, 294; 106/1.15, 1.21

[56] References Cited

U.S. PATENT DOCUMENTS

| | | | |
|---|---|---|---|
| 2,783,192 | 2/1957 | Dean | 204/64 T |
| 2,876,180 | 5/1959 | Burwell et al. | 204/64 |
| 3,444,058 | 5/1969 | Mellors et al. | 204/39 |
| 3,810,770 | 5/1974 | Bianchi et al. | 106/1.21 |

FOREIGN PATENT DOCUMENTS

| | | |
|---|---|---|
| 688546 | 6/1964 | Canada . |
| 163961 | 7/1976 | Czechoslovakia . |
| 2040511 | 2/1971 | Fed. Rep. of Germany . |
| 2075857 | 10/1971 | France . |

OTHER PUBLICATIONS

Scientific American, 221, (2), p. 38, (1969).
Metallurgical Reviews, 106, p. 97 (1966).
Journal of the Electrochemical Society, 113, p. 60 (1966).
Journal of the Electrochemical Society, 102, p. 641 (1955).
Science, 153, p. 1475 (1966).
Journal of the Electrochemical Society, 99, p. 223C (1952).
Journal of Electrochemical Society, 120, p. 1193 (1973).
Journal of Electrochemical Society, 128, p. 1537 (1981).

*Primary Examiner*—Brian E. Hearn
*Assistant Examiner*—Gerard P. Rooney, Jr.
*Attorney, Agent, or Firm*—Arthur S. Collins

[57] ABSTRACT

A low current density, fused salt electrolyte method for depositing passivating metals upon graphite. The passivating metals are applied at 50–100 milliamperes per $cm^2$ for 2–10 minutes followed by further deposition at 5–25 milliamperes per $cm^2$ in an inert fused salt electrolyte bath.

13 Claims, No Drawings

VALVE METAL ELECTRODEPOSITION ONTO GRAPHITE

TECHNICAL FIELD

This invention relates to the electrodeposition of metals upon a graphite material, and particularly to the electrodeposition of valve or refractory metals upon a graphite substrate. More specifically this invention relates to valve metal coated graphite electrodes for use in an electrochemical cell, and to electrodeposition methods for making such valve metal coated graphite electrodes.

BACKGROUND OF THE INVENTION

Chlorine and other halogens are frequently generated by an electrolysis of a brine of a salt of the halogen. Generally the salt is one of an alkali metal and the halogen. Cells used for this electrolytic process are subjected to a harsh chemical environment. Caustic products being produced in the cell, the brine, and the halogen being produced, together can cause a short service life for cell mechanical components. Particularly for electrodes such as the cell anode, where chlorine is evolved during electrolysis, service life can be troublesome.

While previously a relatively inert metal material for use in fabricating anodes for use in these cells was subject of diligent search, more recently electrodes fabricated from passivating or so-called valve metals have found wide acceptance in the generation of halogen by electrolysis. These valve metals commonly are considered to be titanium, tantalum, tungsten, bismuth, aluminum, niobium, zirconium and mixtures of these metals. Generally the valve metals tend to form a surface barrier layer when exposed to oxidants that tends to protect the valve metal from further damage. Often this barrier layer is not significantly electrically conductive.

One valve metal finding broad acceptance for fabricating electrodes for use in halogen generation cells is titanium. Titanium withstands corrosive effects of the cell environment well and is, at least relative to the other valve metals, suitably resistant to corrosive effects of contents of such halogen generating cells. Titanium offers relative availability and cost advantages as a metal for use in fabricating chlorine cell components. On an absolute scale, however, titanium remains relatively expensive, and where a large number of electrodes are required for use in a halogen generating plant, for example, the cost can be substantial.

Another drawback to the use of a pure titanium electrode is the electrical conductivity of the titanium, much less than copper, gold and silver, considerably less than baser metals such as iron and nickel, and substantially less than carbonacious materials such as graphite. When titanium is used to fabricate, particularly, a reticulate electrode widely used for halogen production, considerable care is required to ensure an adequate electrical current distribution throughout the reticulate structure. An inadequate current distribution can result in a relatively elevated power inefficiency in operating an electrolytic cell due to resistance losses as electrical current passes through the reticulate structure. Where the reticulate structure can be fabricated from a relatively conductive substrate having a coating of a valve metal for protection, considerable cost savings are available both in titanium costs and in potential costs of attachment of the reticulate electrode to a current feeder used to distribute electrical current.

Past proposals have attempted to provide titanium coated conductive substrates for use as an electrode by electrolytic deposition of titanium in an aqueous electrolyte. These coatings have generally been unsatisfactory where used in a halogen generating electrolysis cell. Contamination of the titanium coating, nonuniform thickness, relatively poor adhesion to the substrate, and small crystal size are among explanations offered for failures of these titanium coatings giving rise to the dissatisfaction.

In other proposals, pressure cladding of a conductive substrate with titanium has been tried for providing an effective coating. Cladding is the application of one metal to the surface of another using, generally, pressure to create an interdiffused zone between metal at the surface of the substrate and the coating metal. This interdiffused zone includes one or more alloys of the substrate metal and the cladding metal, the metals intertwining in a progression of crystal states corresponding to progressive changes in composition through the zone. This interdiffusion effect can strengthen bonding between the substrate and cladding metal promoting adherence.

In forming reticulate type electrodes, particularly pressure cladding can produce a less than satisfactory result. Particularly at corners or edges of a mesh screening used for reticulate type electrodes, this pressure cladding technique can produce less than a satisfactorily integrated coating. Where pores, or other irregularities are present in a clad coating, attack on the substrate by contents of an electrolytic cell in which the electrode is utilized can quickly cause spalling of coating around the cladding irregularity leading to rapid electrode failure.

For graphite substrates conventional cladding techniques can cause physical damage and achieve less than satisfactory adhesion, depending upon cladding conditions.

Techniques are known for the formation of interdiffused metal coatings upon a substrate using electrodeposition from a fused salt electrolysis bath such as "Flinak" an eutectic mixture of lithium, sodium and potassium fluoride having a melting point of about 454° C. Such techniques are shown and described in U.S. Pat. No. 3,479,159, U.S. Pat. No. 3,864,221, French 1st Publication (Brevet) No. 2,075,857, and in 221 Scientific American 38 (1969). These references generally describe methods for forming solid solutions of coating metals on a substrate and intermetallics of the coating and a metal substrate, but do not describe desirably adequate techniques for providing a relatively pure coating of a valve metal on a relatively pure non-metallic conductive substrate such as graphite.

Upon a graphite substrate, efforts to deposit a valve metal from a fused salt electrolyte have met with a limited success in part due to electrolyte bath components such as potassium tending to become intercalated with the graphite substrate while the valve metal coating is being deposited upon the graphite producing a coating subject to spalling and other failures. Particularly where coatings have been applied under conditions conducive to substantial intercalation, those coatings often do not provide an acceptable base for the application of e.g. precious metal oxides to produce an electrode for use in a chloralkali cell or the like. Yet graphite, as a reasonably efficient electrical conductor, having an effective applied titanium coating could provide an effective electrode for use in a chloralkali cell. Aqueous electrodeposition techniques have generally been found unacceptable for making such a coating.

DISCLOSURE OF THE INVENTION

The present invention provides a method for applying a valve metal coating to a graphite substrate. Such coated substrates find utility for example as components for electrolytic cell electrodes.

Coatings of valve metals are applied to graphite substrates in accordance with the method of this invention by electrodeposition from a fused salt electrolyte under inerted atmospheric conditions. A graphite substrate to which application of a valve metal coating is desired is immersed in the fused salt electrolyte and made cathodic. The fused salt electrolyte includes the valve metal.

Electrical current is passed between an anode immersed in the fused salt electrolyte and the now cathodic graphite substrate initially for a period of between about 2 and 10 minutes at an electrical current density of between about 50 and 200 milliamperes per square centimeter as measured at the surface of the graphite substrate. The current density is then reduced to a range of about 5.0 to 25.0 milliamperes per square centimeter and electrodeposition is continued until a desired thickness of the valve metal is established upon the graphite substrate whereupon electrical current is discontinued.

The graphite substrate, now coated with valve metal generally includes some residual components of the fused salt electrolyte bath that are removed using water or an alcohol, or by extractive leaching with mercury, or by evaporation under vacuum. Removal of these residual bath components is necessary to assure substantial retention of the valve metal coating upon the graphite substrate particularly where the substrate is to be heated significantly.

Following removal of residual fused salt electrolyte components an electrocatalytic coating can be applied to the valve metal coated substrate. Repeated applications of a solution of precursors of platinum group metal oxides each application being followed by heating of the substrate to at least 500° C. to oxidize the precursor provides an electrocatalytic coating suitable for use in electrochemical cells.

Electrodeposition of the valve metal onto the graphite is preferably conducted at an elevated temperature, generally in excess of 770° C. Current can be reversed periodically while electrodepositing the valve metal to assure that the valve metal coating being applied is relatively smooth, uniform, and substantially free of dendrites.

The above and other features and advantages of the invention will become more apparent by reference to the detailed description of the invention which follows, forming a part of the specification.

BEST EMBODIMENT OF THE INVENTION

The present invention provides a method for the electrodeposition of, particularly valve metals, from a fused salt electrolyte upon a graphite substrate. Electrodeposition according to the method of the instant invention results in a graphite structure having an electrodeposited valve metal coating but having a substantially reduced level of intercalation of components of the fused salt electrolyte. Structures resulting from the electrodeposition method of the present invention find utility as electrodes for use in electrolysis cells such as chloralkali cells when provided with an electrocatalytic top coating applied in well known fashion.

Valve metals have found substantial acceptance in, particularly, the chloralkali industry. These valve metals, otherwise known as refractory or so-called passivating metals, include titanium, zirconium, bismuth, niobium, aluminum, tantalum, tungsten and their mixtures. Particularly titanium, partly for cost and relative ease of fabrication reasons and partly for stability reasons, has found broad acceptance as a suitable material for constructing chloralkali electrolytic cell electrodes and particularly for cell anodes.

In the chloralkali cell environment, a titanium anode quickly passivates, forming a protective film that substantially resists corrosive effects of contents of the chloralkali cell. This passivation while offering the opportunity for an aspect of dimensional stability when operating the electrode in an aggressive cell environment also effectively terminates any significant electrolytic activity at the anode by reason of this passive layer being substantially nonelectrically conductive.

Coating of a titanium electrode with an electrocatalyst can maintain electrical activity of the electrode while capitalizing upon the corrosion resistivity of the titanium electrode structure. A variety of electrocatalyst formulations may be utilized effectively in a chloralkali cell. Typically the catalyst is a platinum group metal, ruthenium, rhodium, iridium, palladium, osmium, or platinum; gold or silver; or an oxide of one or more platinum group metals; or a mixture of the foregoing. With some of the electrocatalysts, it has been found beneficial to include oxides of other metals such as antimony, tin, valve metals and manganese mixed either with the electrocatalyst or applied separately as a top coating.

Preparation and application of conventional electrocatalysts is now well known in the art; and for purposes of implementing this instant invention, any suitable or conventional electrocatalyst and method of application may be used in preparing an electrode made in accordance with the invention. Certain of the electrocatalytic compounds, particularly the platinum group metal oxides are applied by placing a precursor compound including the platinum group metal upon the electrode and then heating the electrode to convert the precursor compound including the platinum metal to an oxide of the platinum group metal. For example, ruthenium chloride and rhodium chloride dissolved in an acidified alcohol and painted upon a titanium electrode, heated at about 525° C. for 5 to 15 minutes are converted to a ruthenium oxide and rhodium oxide electrocatalytic coating upon the titanium substrate.

In practicing the instant invention, a graphite substrate is immersed in a fused salt electrolysis bath containing the valve metal to be electrodeposited upon the substrate. The substrate is made cathodic within the bath whereupon the valve metal, in this best embodiment titanium, electrodeposits upon the substrate to form a coating of the valve metal upon the substrate. The resulting coating should be a dense, impurity-free coating relatively uniform in thickness and substantially free of voids.

Impurities, it has been found, can arise in electrodeposition of titanium where water and/or oxygen are present. Particularly the presence of hydronium ions adjacent sites of titanium electrodeposition can be difunctional to achieving a desired titanium coating. In part for that reason, substrates electrodeposited with titanium from an aqueous electrolysis bath have generally produced less than a desirable coated electrode.

One impurity of particular significance when electrodepositing a valve metal upon graphite consists of alkali metals such as potassium that may be present in the fused salt electrolytic bath. These fused salt baths generally include alkali metal halides and upon occasion alkaline earth metal halides. Particularly chlorides and fluorides of lithium, sodium, and potassium have found acceptance in fused salt electrolyte baths. One typical mixture, flinak, a well known mixture of lithium, potassium and sodium fluorides, finds utility in the practice of this invention.

Particularly potassium in these electrolyte mixtures tends to codeposit with titanium upon the graphite substrate, and penetrates the somewhat porous graphite substrate to intercalate the crystal lattices of the graphite. Should substantial quantities of this potassium intercalate the graphite substrate being coated with a valve metal, and should the valve metal coated substrate be subsequently heated to a temperature at which the potassium possesses a substantial vapor pressure, delamination or spalling of the valve metal coating can result. Such an elevated temperature can be encountered for example when oxidizing precursors of electrocatalytic substances applied to the valve metal coated substrates.

In the electrodeposition method of the instant invention, intercalation is suppressed by the manner in which the valve metal is deposited upon the graphite. It has been found that a particularly desirable electrodeposit of a valve metal on a conductive graphite substrate suitable for use as an electrode can be obtained by electrodeposition in a fused salt electrolysis bath. The bath salts generally preferred for use in the practice of the instant invention are halide salts of Periodic Table Group I and II metals. The Group I or alkali metals are lithium, sodium and potassium, preferred in the practice of this invention, and rubidium, cesium, and francium. The Group II or alkaline earth metals are magnesium, calcium, strontium and barium, generally preferred in practicing the instant invention, and radium. Beryllium salts are generally not as suitable for use in an electrolysis bath for the practice of the instant invention.

Any halide, fluorine, chlorine, bromine or iodine can be used in the electrolysis bath salts for practicing the instant invention. Fluoride and, to a lesser extent, chlorides are much preferred in practicing the instant invention as they provide a fluxing action during deposition of metals in the electrolysis bath. Mixtures of the alkali and alkaline earth metal halide salts will produce satisfactory results in the practice of the instant invention.

The fused salt or molten electrolyte should also contain the valve metal being electrodeposited. The valve metal can be present in any quantity from a trace amount to saturation of the fused salt electrolyte with the valve metal being deposited. It is preferred, however, that valve metal being electrodeposited be present in the fused salt electrolyte in a concentration of between about 5 and 15 weight percent. The concentration preferred varies within this range partly as a function of the valve metal being electrodeposited and the other salts present in the fused salt electrolyte.

The nature of the fused electrolysis bath to some extent also determines the lower operating temperature available for carrying out the instant invention. Some halide salt mixtures such as flinak, a eutectic mixture of lithium, potassium, and sodium fluoride salts and much preferred as the fused salt electrolyte in the practice of the instant invention, become molten at a temperature as low as 454° C., while others remain crystalline until reaching a considerably more elevated temperature. Some operational parameters of the instant invention, such as the electrical conductivity of the graphite substrate being coated occasionally depend in part upon the temperature at which the process of the instant invention is operated. Selection of a suitable operational electrolysis bath temperature is, therefore, of some import. Where coating graphite with titanium, preferably, the electrolysis bath is maintained at a temperature of at least 770° C., and most preferably in excess of 850° C.

In a fused salt electrolyte such as flinak, the presence of sufficient water in the bath to present a hydronium ion difficulty at the site of valve metal electrodeposition is remote, as a result of the elevated bath temperature required to melt the salts. While the bath may initially include other impurities that may interfere with achieving a desired dense, generally uniform and impurity-free coating of the valve metal upon the graphite substrate, these impurities may be removed by electrodeposition from the bath upon scrap substrates until desired characteristics of the electrodeposit are achieved.

One significant impurity, oxygen, may be substantially excluded from the electrolytic bath which is made impurity free by performance of electrolysis under an inerted atmosphere. Argon, helium, and in some cases nitrogen are suitable for inerting. It may be desirable to treat inerting gases to remove residual oxygen prior to introducing the gas into an apparatus used for electrodeposition.

In the preferred embodiment, inert gas is introduced subsurface to the fused salt electrolyte. Subsurface introduction promotes turbulent mixing within the fused salt electrolyte, valuable where concentration gradients may become established, for example, during elevated current density operation. Subsurface introduction of the inert gas serves also to assist in stripping such compounds as HF from the fused salt electrolyte.

Initially, electrodeposition from the fused salt electrolysis bath is constrained generally to a current density measured at the substrate being coated of 100 milliamperes per square centimeter or less as measured at the surface of the graphite substrate, but not less than about 50 milliamperes per square centimeter (ma/cm$^2$). At a more elevated current density than about 100 ma/cm$^2$, the electrodeposited valve metal generally substantially lacks the uniformity and large crystal grain sizing necessary for effecting a desired long-lived electrode coating.

Electrodeposition at this elevated current density is continued for between about 2 and 10 minutes, and preferably for between about 5 and 10 minutes. During this period of electrodeposition, both the valve metal and the alkali metals, e.g. potassium, accumulate upon the graphite substrate with the valve metal eventually sealing the surface against the deposition of further quantities of alkali metal. Once the graphite surface is sealed by the depositing valve metal, the electrodeposition current is reduced to between about 5.0 and 25.0 ma/cm$^2$ and electrodeposition is continued until a valve metal coating of desirable thickness is established upon the graphite substrate. In some applications, the coating valve metal may tend to develop dendrites or other surface irregularities in coating the substrate. In this best embodiment, these irregularities are controlled by periodically reversing polarity in the electrodeposition cell, making the substrate temporarily anodic. Reversal is preferably accomplished at a current density substantially greater than the current being used for electrodeposition. Reversal is preferably continued only briefly, for example 15 minutes, during a 2-hour electrodeposition cycle.

During electrodeposition at this lower current density, that is 5.0 to 25.0 ma/cm$^2$, alkali metal entering between crystallization lattices of the graphite prior to the graphite surface being sealed by the valve metal tend to migrate to uncoated surfaces of the graphite not immersed in the electrolyte if any. This alkali metal is then at least partially removed by evaporation from the substrate within the inerted electrodeposition chamber.

The relatively elevated initial current for electrodeposition is necessary to seal the immersed surfaces of the graphite substrate with the valve metal. Alkali metals, and particularly potassium tend to predeposit or preferentially deposit upon the graphite surfaces, at least until the surface is saturated. These predeposits of alkali metal tend to diffuse into the crystalline lattice of the graphite or lamellar spacing of the graphite so that at a lower current density the surface of the graphite remains less than saturated with alkali metal promoting continued predeposition of the alkali metal. At a more elevated current density, however, the potassium predeposits upon the graphite surface rapidly, saturating the surface. At these elevated currents the valve metal also codeposits rapidly with the alkali metal upon the saturated graphite surface quickly sealing the graphite surface. Once sealed, predeposition of the alkali metal upon the surface effectively ceases and a desired layer of valve metal can be completed upon the graphite. Conversely, at lower current densities, the surface may never become sealed due to continued alkali metal deposition at the substrate (graphite) surface to replace alkali metal lost from the surface due to diffusion into the graphite lamellar structure.

For some valve metals, such as titanium, the rate of electrodeposition and the valence of ions of the titanium at the point of electrodeposition from the fused salt electrolysis bath can, to a substantial extent, determine the quality of the valve metal coating achieved upon the conductive substrate. Particularly for titanium, the valence of ions being electrodeposited should be $Ti^{+3}$. Where $Ti^{+4}$ ions electrodeposit in substantial quantity, the resulting coating can form as a solidified salt crust substantially disfunctional to obtaining a desired valve metal coating.

In a typical flinak electrolysis bath, a satisfactory proportion of $Ti^{+3}$ can generally be obtained where metallic or ground state titanium is available in the electrolyte bath during electrodeposition. It is believed that a reaction occurs whereby $Ti^0 + 3Ti^{+4} \rightleftarrows 4Ti^{+3}$. Since generally the quantity of $Ti^{+4}$ present in a typical electrolysis bath is small, the quantity of $Ti^0$ introduced into the bath can be correspondingly small.

Likewise operation at the elevated 50–100 ma/cm$^2$ current density significantly in excess of between about 5 and 10 minutes can result in a valve metal electrodeposition of less than desirable quality. Particularly, an undesirably small grain structure in the deposit can result, or the deposit can be flaky or loosely adhered to the graphite, or may contain pin holes or the like contributing to subsequent spalling of the coating. For that reason it is necessary that the electrodeposition current be reduced soon after establishing the initial deposit to seal the graphite surface.

In the process of the instant invention, a competing reaction, $Ti^0 + 3K^+ = Ti^{+3} + 3K^0$, can, under certain circumstances where $K^0$ can escape the electrolysis bath, quickly exhaust an electrolysis bath of $Ti^0$. Exhaustion can occur, for example, by vaporization of K from the bath and subsequent crystallization of the K in vapor spaces of the electrodeposition cell. This phenomenon can be suppressed by the exercise of caution in insulating the vapor spaces of the electrolytic cell and in suitably preheating inerting gases fed to the vapor spaces.

It is preferable that cell materials of construction be not readily corroded by fluoride melts, and that the metal(s) selected for cell constructions be more electronegative (less active) than the valve metal being electrodeposited so as to not displace valve metal solute from the electrolysis bath. The electrolysis cell can be fabricated from a variety of suitable and conventional materials including titanium, graphite, Inconel® 600 and Monel® proprietary nickel alloys marketed by International Nickel Co., nickel and molybdenum. Stainless steels, while less desirable, are also useful.

Anodes, where not made of the valve metal being electrodeposited, may be made from graphite or other suitable anode materials. Materials used in fabricating electrolysis cells for the practice of the instant invention generally should be resistant to the elevated temperatures associated with fused salt systems as well as resistant to corrosive and solvating effects of fused salt baths.

Where fused salt electrolyte is prepared external to the electrodeposition cell, treatment by preliminary electrolysis or the like is generally required to remove impurities prior to use in the cell. The fused salt is preferably stored in an inerted atmosphere to forestall reintroduction of, particularly, oxygen related contaminants.

After valve metal coating has been established upon the graphite substrate, intercalated alkali metal must be removed from the graphite substrate, and from the valve metal coating applied to the substrate. Removal can be effected by soaking the coated graphite substrate in water at 75°–90° C., or by immersion in an alcohol such as methanol, ethanol, or propanol. The alkali metal can be leached by immersion in mercury, or by evaporation under a vacuum at elevated temperature in well known manner. The alkali metal during electrodeposition tends to migrate to uncoated graphite surfaces external to the electrolyte bath facilatating this removal.

This alkali metal removal is necessary where the coated graphite substrate is to be coated with an electrocatalyst precursor that requires oxidation at an elevated temperature, such as are well known in the field of electrochemistry.

Optionally, prior to commencing electrodeposition, it may be desirable to soak the graphite substrate in the fused salt electrolyte for 5 minutes or more.

The following examples are offered to further illustrate the invention. These following examples were conducted in a titanium crucible containing 1325 grams of flinak containing 7 weight percent titanium trifluoride and including sodium hydrogen fluoride. The crucible included a 0.635 centimeter diameter by 77 centimeter long titanium rod which was made anodic to graphite substrates immersed in the flinak. The crucible was maintained under an inerting gas blanket of helium at all times, graphite substrates being introduced into the crucible and removed from the crucible utilizing an air lock. The flinak, comprising electrolyte in the crucible electrodeposition cell was initially heated to 454° C. to melt the electrolyte and then heated to operating temperatures for a particular experiment.

EXAMPLE I

With the electrolyte at 775° C., a 0.63 centimeter in diameter by 3.2 centimeter long graphite rod was immersed in the electrolyte and made cathodic to the anode. Current was passed between anode and cathode at a current density of 50 milliamperes per square centimeter (ma/cm$^2$) for a period of 5 minutes after which the flow of current between anode and cathode was reduced to 24.3 ma/cm$^2$ for 55 minutes. A smooth titanium coating resulted upon the graphite rod.

EXAMPLE II

With the electrolyte at 780° C., a rectilinear graphite block 5 centimeters by 0.635 centimeters by 1.9 centimeters was immersed to a depth of 2.54 centimeters of its length into the electrolyte. Made cathodic, electrical current was passed between the anode and the now cathodic graphite block at an initial current density of 50 amperes per square centimeter for five minutes and then at a current density of 24.8 ma/cm$^2$ for 55 minutes. A smooth titanium coating resulted upon the graphite block with a few small dendrites.

EXAMPLE III

With the electrolyte bath at 860° C., a 0.635 centimeter in diameter by 2.85 centimeter long graphite rod was immersed in the electrolyte and made cathodic. Current was passed between anode and cathodic graphite rod at 83.1 ma/cm$^2$ for 5 minutes and then 16.6 ma/cm$^2$ for 955 minutes. A smooth titanium coating resulted upon the rod with several dendrites.

EXAMPLE IV

With the electrolyte bath at 860° C., a 0.635 centimeter diameter by 3.5 centimeter in length graphite rod was partially immersed into the electrolyte and made cathodic. Electrical current was passed between anode and cathodic graphite rod at 68.7 ma/cm$^2$ for 5 minutes and 13.7 ma/cm$^2$ for 235 minutes. A smooth titanium coating resulted upon the graphite rod with some insignificant dendrite formation at the melt line.

EXAMPLE V

With the electrolyte at 860° C., a 0.635 centimeter diameter by 3.8 centimeter in length graphite rod was partially immersed into the electrolyte. Made cathodic, electrical current was passed between the anode and the cathodic graphite rod at 63.1 ma/cm$^2$ for 5 minutes followed by 12.6 ma/cm$^2$ for 925 minutes. A smooth titanium coating resulted upon the graphite rod having dendrites only at the melt line.

EXAMPLE VI

With the electrolyte at 775° C., a 0.635 centimeter diameter by 3.2 centimeter long graphite rod was immersed in the electrolyte and made cathodic. Current was flowed between anode and the cathodic graphite at 189.9 ma/cm$^2$ for 5 minutes followed by 94.9 ma/cm$^2$ for 115 minutes. A very dendritic titanium coating resulted upon the graphite rod, a coating deemed unacceptable where it is desired that the titanium coated graphite rod be used subsequently for electrode purposes for example in chloralkali cell.

EXAMPLE VII

The coated graphite substrates of Examples I through V were immersed for 48 hours in a 50/50 mixture of ethanol and methanol. Each of the titanium coated graphite substrates was then painted with a butanol solution of ruthenium chloride and titanium chloride, the solution being made acidic by the addition of hydrochloric acid, and the painted titanium coated graphite substrates were fired at 525° C. for 10 minutes. Painting and firing was repeated 7 additional times. The substrates, now coated with an electrocatalyst for evolving chlorine in an alkali cell, were installed in the anode compartment of a lab scale chloralkali cell and were used to evolve chlorine.

While a preferred embodiment of this invention is shown and described in detail, it should be apparent that various alterations and modifications can be made thereto without departing from the scope of the claims that follow.

What is claimed is:

1. A method for electrolytically applying a coating of titanium upon a graphite substrate comprising the steps of:

(a) in an inerted atmosphere making the graphite substrate cathodic while immersed in a molten alkali or alkaline earth metal salt electrolyte containing titanium in the trivalent state;

(b) initially passing electrical current between an anode immersed in the bath and said cathodic substrate at a current density of between 50 and 200 milliamperes per square centimeter measured at the substrate for between 2 and 10 minutes;

(c) then passing electrical current in similar fashion but at a reduced current density of between about 5 and 25 milliamperes per square centimeter until a titanium coating of desired thickness is established upon the substrate; and after removing the coated substrate, (d) treating same to eliminate therefrom residual contaminants derived from the alkali or alkaline earth metal salts.

2. The method of claim 1 wherein said step (d) entails any one of the following:

(1) soaking in water or alcohols, (2) extractive leaching with mercury, (3) evaporation under vacuum.

3. The method of claim 1 wherein said anode is predominantly titanium.

4. The method of claim 1 wherein said molten salt electrolyte consists essentially of fluorides including those of potassium, lithium and sodium.

5. The method of claim 1 wherein the molten salt electrolyte is maintained at a temperature of at least 770° C.

6. The method of claim 1 wherein said molten salt electrolyte consists essentially of fluorides.

7. The method of claim 6 wherein said electrolyte is maintained at a temperature of at least 770° C. and said fluorides include KF, LiF and NaF.

8. A method for electrolytically applying a titanium coating to a graphite substrate to produce a corrosion resistant electrode element for an electrochemical cell comprising the steps of:

(a) in an inerted atmosphere making the graphite substrate cathodic while immersed in a molten alkali or alkaline earth metal salt electrolyte containing titanium in the trivalent state;

(b) initially passing electrical current between a titanium metal anode immersed in said electrolyte and said cathodic substrate at a current density of between 50 and 200 milliamperes per square centimeter measured at the substrate for between 2 and 10 minutes;

(c) then passing electrical current in similar fashion but at a reduced current density of between about 5 and 25 milliamperes per square centimeter until a titanium coating of desired thickness is established upon the substrate; and, after removing the coated substrate, (d) treating same to eliminate therefrom residual contaminants derived from the alkali or alkaline earth metal salts.

9. The method claim 8 wherein trivalent titanium represents only a few percent by weight of said molten said electrolyte in step (a) thereof.

10. The method of claim 8 wherein occasionally during step (c) thereof, the polarities of said anode and cathodic substrate are briefly reversed.

11. The method of claim 8 wherein the step (d) entails any one of the following:

(1) soaking in water or alcohols, (2) extractive leaching with mercury, (3) evaporation under vacuum.

12. The method of claim 8 wherein the molten salt electrolyte consists essentially of fluorides, including those of potassium, lithium and sodium and the temperature of said electrolyte is above 770° C.

13. The method of any of claims 8 through 12 including the additional step of applying an electrocatalyst to the titanium coated graphite substrate following said step (d).

* * * * *

UNITED STATES PATENT AND TRADEMARK OFFICE

CERTIFICATE OF CORRECTION

PATENT NO. : 4,483,752

DATED : November 20, 1984

INVENTOR(S) : George A. Kline

It is certified that error appears in the above-identified patent and that said Letters Patent are hereby corrected as shown below:

In Claim 9, Line 3, delete the word "said" and insert the word --salt--.

Signed and Sealed this

*Ninth* Day of *April 1985*

[SEAL]

*Attest:*

DONALD J. QUIGG

*Attesting Officer*

*Acting Commissioner of Patents and Trademarks*